US005214942A

United States Patent [19]

Peake, III et al.

[11] Patent Number: 5,214,942

[45] Date of Patent: Jun. 1, 1993

[54] LOOP-TYPE TEXTILE FASTENER FABRIC AND METHOD OF PRODUCING SAME

[75] Inventors: William L. Peake, III; Robert T. Spillane, both of Greensboro, N.C.

[73] Assignee: Guilford Mills, Inc., Greensboro, N.C.

[21] Appl. No.: 711,201

[22] Filed: Jun. 6, 1991

[51] Int. Cl.[5] ..... A44B 18/00

[52] U.S. Cl. ..... 66/194; 24/445

[58] Field of Search ..... 66/194, 195; 24/445

[56] References Cited

U.S. PATENT DOCUMENTS 3,594,873 7/1971 Hockmeyer, Jr. et al. .
3,597,941 8/1971 Jindra et al. ..... 66/194
3,748,701 7/1973 De Mestral .
3,943,981 3/1976 De Brabander .
4,338,800 7/1982 Matsuda ..... 66/194
4,467,625 8/1984 Kurz ..... 66/194 X
4,624,116 11/1986 Rogers .
4,677,011 6/1987 Matsuda ..... 66/194 X
4,709,562 12/1987 Matsuda .
4,714,096 12/1987 Guay .
4,822,658 4/1989 Pacione .
4,838,044 6/1989 Matsuda et al. .
4,858,447 8/1989 Matsuda ..... 66/194 X
4,881,383 11/1989 Spillane et al. ..... 66/194

*Primary Examiner*—James R. Brittain
*Attorney, Agent, or Firm*—Shefte, Pinckney & Sawyer

[57] ABSTRACT

A lightweight warp knitted textile fabric suitable for use as the loop component of a hook-and-loop fastener is formed of two sets of ground yarns knitted in a dimensionally stable construction with a set of loop-forming yarns formed in a stitch pattern producing elongated underlap loops extending outwardly from the technical back of the fabric which can be readily interengaged with the hook elements of a mating hook component without any necessity for brushing, napping or mechanically raising the loops. In one embodiment, the loop-forming yarns are relatively fine denier synthetic monofilament yarns whose relative stiffness and resiliency accentuates the upstanding disposition of the loops.

12 Claims, 1 Drawing Sheet

LOOP-TYPE TEXTILE FASTENER FABRIC AND METHOD OF PRODUCING SAME

BACKGROUND OF THE INVENTION

The present invention relates generally to fabric fasteners of the type commonly referred to as hook-and-loop fasteners. More particularly, the present invention relates to a novel warp-knitted loop-type textile fastener fabric and a method of producing such a fastener fabric on a warp knitting machine.

So-called hook-and-loop fasteners have gained considerable popularity over recent years. Such fasteners basically include two generally flat components attachable and detachable to and from face abutting relation with one another. Typically, each fastener component is of a textile fabric construction, the hook or "male" component having a fabric ground layer with a plurality of relatively stiff hook-shaped elements extending in upstanding relation from one face of the ground layer and the loop or "female" component similarly having a fabric ground layer with a plurality of relatively flexible pile-type loops extending outwardly from one face of the ground layer. In use, the hook and loop faces of the fastener components grippingly engage one another when pressed together in face abutting relation by penetration of the hook-shaped elements of the hook component into the loops at the opposing face of the loop component. The engagement between the hook and loop faces of the two components resists separation thereof until a threshold force is exerted on one component in a peeling-like fashion.

Typically, both components of conventional hook-and-loop fasteners have been of relatively heavyweight constructions. For example, many hook components utilize hook elements formed of relatively heavy denier inflexible synthetic monofilament yarns firmly secured in a similarly stiff inflexible ground fabric, to withstand repeated attachment and detachment to and from a mating loop component without excessive breakage of the hook elements or tearing of the ground fabric. Similarly, loop components commonly have a relatively stiff inflexible ground layer supporting elongated loops of multifilament synthetic yarns, which normally are brushed or napped to produce a plush-like loop surface wherein the individual filaments are mainly separated from one another, in order to maximize the available loops for engagement with the mating hook-like elements of the other fastener component. Thus, although a number of the individual filaments in the loops may be broken each time the hook and loop components are attached and then detached, the large number of available loops owing to the use of napped or brushed multifilament yarns enables the loop component to be repeatedly attached and detached to and from its mating hook component so that the fastener generally has a reasonably extended useful life.

Virtually without exception, conventional hook-and-loop fasteners are fabricated with each fastener component in the form of a relatively narrow width tape of indeterminate length. As such, hook-and-loop fasteners are susceptible to a wide variety of end uses, most often as a fastener or closure in various apparel items wherein the capability of the fastener components for repetitive attachment and detachment to and from one another is a virtual necessity.

However, a variety of other uses for hook-and-loop fasteners has also been proposed. For example, U.S. Pat. No. 4,822,658 discloses a carpet construction with a backing layer having plural downwardly projecting loops serving the dual purpose of providing resiliency to the underside of the carpet in the nature of underpadding while also being adapted for engagement with a hook-type fastener tape affixed to a floor surface for purposes of securing the carpeting in place on the floor. To economically produce this product, a loop-type fastener component for use as the backing layer must be fabricated in the same widths as carpeting is typically fabricated, e.g., twelve-foot widths or greater. However, no conventional hook-and-loop fastener constructions are known to be fabricated in such widths to be suitable for the use contemplated by this patent. Moreover, since the looped underlayer of this carpet construction would not be repeatedly engaged with and disengaged from the mating hook fastener tape but instead would generally perform a one-time use, the loop components of conventional hook-and-loop fasteners of the type described above would not be optimally suitable for use in such carpet construction in any event.

Other uses which have been proposed for hook-and-loop fasteners include the formation of closures in disposable or one-time use products, such as diapers and incontinence garments, for which the above-described conventional hook-and-loop fasteners would also be generally inappropriate.

SUMMARY OF THE INVENTION

It is accordingly an object of the present invention to provide a novel loop component for use in a hook-and-loop fastener which is suitable for uses wherein repeated attachment and detachment to and from a mating hook component is generally unnecessary. A particular object of the present invention is to provide such a loop component which is specifically suitable for use as a backing in a carpet construction such as disclosed in the aforementioned U.S. Pat. No. 4,822,658, closures for disposable articles, and in other one-time and light-duty uses.

It is a further object of the present invention to provide a loop component for a hook-and-loop fastener of a warp knitted textile fabric construction wherein the loop-forming yarn is knitted in a stitch pattern causing the surface loops to be elongated and to extend outwardly from the fabric without brushing, napping or otherwise mechanically raising the loops. A more specific object is to provide such a loop component utilizing a relatively fine denier monofilament synthetic yarn for formation of the surface loops on one face of the fastener component.

An additional object of the present invention is to provide a novel warp knitting method for fabricating the loop fastener component of the present invention.

Briefly summarized, the present invention provides a textile fabric having loops at one face adapted for mated engagement with hooking elements of another fabric for use in a two-component fabric fastener of the hook-and-loop type. Basically, the fabric fastener component of the present invention includes a ground layer formed of a ground yarn and a plurality of fastener loops of another loop-forming yarn extending outwardly from one face of the ground layer. According to one aspect of the present invention, the fastener fabric is formed of a warp knitted construction with the fastener loops appearing at the technical back of the fabric. More specifically, the warp knitted fastener component includes yarns formed in needle loops arranged in longitudinally extending wales and transversely extending courses including at least one set of ground yarns formed in a dimensionally stable stitch pattern of needle loops and a set of loop-forming yarns formed in needle loops in spaced courses and spaced wales and in elongated underlap loops extending outwardly from the technical back of the fabric from the needle loops.

Preferably, each loop-forming yarn is formed in needle loops aligned with one another in spaced courses of a common wale. For example, the loop-forming yarns may be warp knitted in a 1-0, 3-4, 6-7, 3-4 stitch pattern. It is also preferred that the ground yarns include two sets of ground yarns, one set being formed in needle loops in spaced wales of every course, e.g., warp knitted in a 1-0, 4-5 stitch pattern, and a second set being formed in needle loops in a chain stitch pattern also in the spaced wales, e.g., in a 0-1, 1-0 chain stitch pattern.

According to another aspect of the present invention, the fastener loops may be formed of a monofilament synthetic yarn, e.g., polyester, of a relatively fine denier in the range of approximately 40 denier and smaller, preferably between 20 and 40 denier.

The present invention also contemplates a method of producing a warp knitted textile fabric suitable for use as the loop component of a hook-and-loop type fastener. Basically, the present method includes the steps of warp knitting two sets of ground yarns on the bottom and middle guide bars of a three-bar warp knitting machine to form a ground layer of the fabric in a dimensionally stable relatively non-stretchable construction while simultaneously warp knitting a set of loop-forming yarns on the top guide bar of the knitting machine in elongated underlaps forming raised loops at the technical back of the fabric.

According to one aspect of the present method, the loop-forming yarns are knitted by alternately forming needle loops of the loop-forming yarns on selected needles of the knitting machine's needle bar and interveningly holding the loop-forming yarns in a non-knitting manner on, and then releasing the loop-forming yarns without stitch formation from, other needles spaced from the selected needles to form the elongated outwardly-extending underlap loops at the technical back of the fabric between the needle loops of the loop-forming yarns.

In the preferred embodiment of the present method, the first set of ground yarns are warp knitted in a 1-0, 4-5 stitch pattern, the second set of ground yarns are warp knitted in a 0-1, 1-0 chain stitch pattern, and the loop-forming yarns are warp knitted in a 1-0, 3-4, 6-7, 3-4 stitch pattern.

According to another aspect of the present method, monofilament synthetic yarns of relatively fine denier in the range of about 40 denier and smaller may be utilized as the loop-forming yarns.

DESCRIPTION OF THE PREFERRED EMBODIMENT

Figure 1:
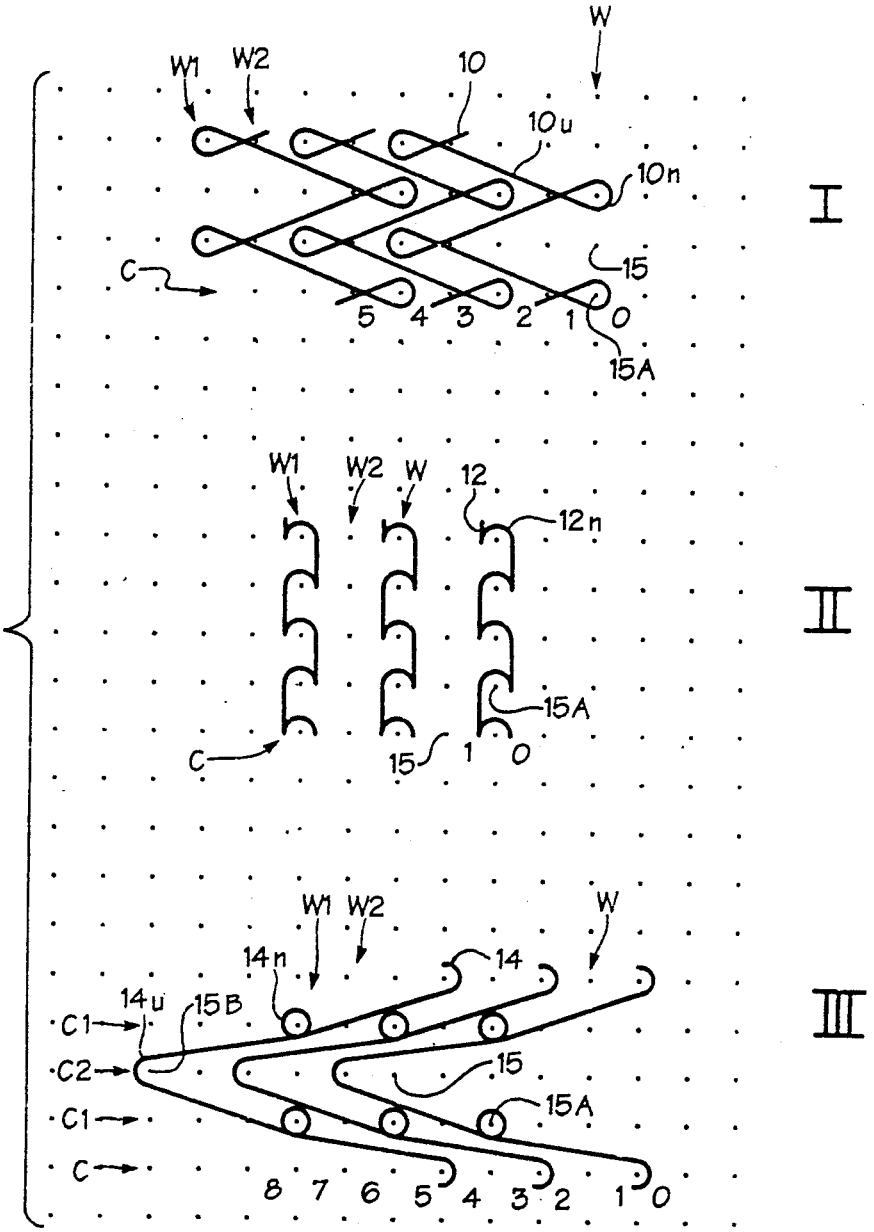
FIG. 1 is a diagram showing individually the stitch pattern for the ground and fastener loop-forming yarns carried out by a warp knitting machine in knitting one preferred embodiment of the present fabric according to the method of the present invention.

As explained more fully herein, the preferred embodiment of the fabric of the present invention is produced, and the method of the present invention is carried out, on a warp knitting machine which may be of any conventional type of an at least three-bar construction having three or more yarn guide bars and a needle bar, e.g., a conventional tricot warp knitting machine. The construction and operation of such machines are well known in the warp knitting art and need not herein be specifically described and illustrated. In the following description, the yarn guide bars of the knitting machine are identified as "top," "middle" and "bottom" guide bars for references purposes only and not by way of limitation. As those persons skilled in the art will understand, such terms equally identify knitting machines whose guide bars may be referred to as "front," "middle" and "back" guide bars, which machines of course are not to be excluded from the scope and substance of the present invention. As further used herein, the "bar construction" of a warp knitting machine refers to the number of yarn guide bars of the machine, while the "bar construction" of a warp knitted fabric refers to the number of different sets of warp yarns included in the fabric, all as is conventional terminology in the art.

Referring now to the accompanying drawings, one particular embodiment of the present textile fabric is illustrated as preferably warp knitted of a three-bar construction on a three-bar warp knitting machine according to the present method. As is conventional, the needle bar of the warp knitting machine carries a series of aligned knitting needles, while each guide bar of the machine carries a series of guide eyes, the needle and guide bars preferably having the same gauge, i.e., the same number of needles and guide eyes per inch. According to the illustrated embodiment of the present fabric, the bottom guide bar of the machine is threaded on alternating guide members with a first set of ground yarns 10 delivered from a warp beam (not shown), the middle guide bar is threaded on alternating guide members with a second set of ground yarns 12 delivered from another warp beam (also not shown), and the top guide bar is similarly threaded on alternating guide members with a set of loop-forming yarns 14 supplied from a third warp beam (also not shown). As more fully explained hereinafter, the threading arrangement of the three guide bars is set up in conjunction with the stitch patterns of the three sets of yarn to deliver the ground and loop-forming yarns 10, 12, 14 to every alternate needle of the needle bar during the formation of alternate fabric courses and, then, to deliver the ground yarns 10, 12 to every alternate needle of the needle bar while delivering the loop-forming yarns 14 to every intervening needle during the formation of intervening fabric courses. For this purpose, the bottom yarn guide bar has every alternate guide eye threaded with a ground yarn 10 and every intervening guide eye empty, commonly referred to as a "one in, one out" threading arrangement, while the middle and top yarn guide bars have every intervening guide eye threaded with a respective ground yarn 12 or 14 and every alternate guide eye empty, i.e., a "one out, one in" threading arrangement.

It is contemplated that a variety of yarns may be suitable for use as the ground and loop-forming yarns.

Preferably, the ground yarns 10, 12 are inelastic so as to contribute, in conjunction with the fabric stitch construction itself, to the dimensional stability of the fabric. For example, any of a variety of conventional multifilament synthetic yarns, particularly polyester and nylon yarns, would be suitable for use as the ground yarns. The denier of the ground yarns may vary depending upon the desired weight of the fabric per unit fabric dimension (ounces per square yard). By way of example, ground yarns varying in denier from 40 to 95 could be utilized, although it is also contemplated that lesser or greater denier yarns could also be utilized in appropriate circumstances.

Likewise, a variety of possible yarn types may be utilized as the loop-forming yarns. In one contemplated embodiment, the loop-forming yarns are synthetic monofilament yarns, e.g., polyester or nylon, of a relatively fine denier, i.e., in the range of approximately 40 denier or less, preferably between 20 and 40 denier. Such monofilament loop-forming yarns are relatively strong yet relatively lightweight and, further provide greater resiliency and stiffness in comparison to multifilament yarns of comparable denier whereby fastener loops of such yarns formed at the surface of the fabric tend naturally to extend outwardly in generally upstanding relation to the fabric face and to maintain such disposition over the course of use, thereby eliminating any need for napping, brushing or other mechanical raising of the fastener loops from the fabric surface. On the other hand, other embodiments of the present fabric are contemplated utilizing multifilament synthetic yarns, preferably within the same denier range.

In the accompanying FIG. 1, the stitch constructions of the ground and loop-forming yarns 10, 12, 14, as carried out by the respective lateral traversing movements of the guide bars of the knitting machine according to one possible embodiment of the present fabric and method, are illustrated individually in a traditional dot or point diagram format, wherein the individual points 15 represent the needles of the needle bar of the knitting machine in the formation of several successive fabric courses C across several successive fabric wales W. According to this embodiment, the bottom guide bar of the warp knitting machine manipulates the first set of ground yarns 10 as they are fed from their respective warp beam to traverse laterally back and forth relative to the needle bar of the machine to stitch the ground yarns 10 on alternate needles 15A in a repeating 1-0, 4-5 stitch pattern, as indicated at I of FIG. 1. Simultaneously, the middle guide bar of the knitting machine manipulates the second set of ground yarns 12 as they are fed from their respective warp beam to traverse relative to the needle bar to stitch the ground yarns 12 on the same alternating needles 15A in a repeating 0-1, 1-0chain stitch pattern, as indicated at II in FIG. 1. The top guide bar simultaneously manipulates the set of loop-forming yarns 14 as they are fed from their respective warp beam to traverse relative to the needle bar alternately to stitch the loop-forming yarns 14 on the same alternating needles 15A and then to lay the yarns 14 without stitch formation about spaced intervening needles 15B in a repeating 1-0, 3-4, 6-7, 3-4 stitch pattern, as indicated at III of FIG. 1. The respective simultaneous stitch patterns of the ground and loop-forming yarns 10, 12, 14 are shown in a composite dot diagram in FIG. 2.

As will thus be understood, the ground and loop-forming yarns 10, 12, 14 are interknitted with one another by formation of respective needle loops **10*n*, 12*n*, 14*n* of the yarns in alternating wales W1 of the resultant fabric, without any needle loops of any of the yarns being formed in the intervening wales W2. More specifically, the stitch construction of the ground yarns 10 forms needle loops 10*n* thereof in alternating wales W1 of every course C, each ground yarn 10 having its needle loops 10*n* alternating every course C across five wales between two wales W1 spaced apart by an intermediate wale W1 and two intervening wales W2 across which elongated underlaps 10*u* of the ground yarn 10 extend diagonally between the successive needle loops 10*n* in a substantially coursewise direction. The ground yarns 12 are formed only in the alternating wales W1, each ground yarn 12 being formed in one respective wale W1 in needle loops 12*n* aligned walewise with one another in every course C, owing to the chain stitch construction of these yarns 12. The stitch construction of the loop-forming yarns 14 form them in needle loops 14*n* appearing only in alternating courses C1 and in the alternating wales W1, each loop-forming yarn 14 having its needle loops 14*n* formed in the alternating courses C1 and in a common wale W1 with an underlap extent 10*u* extending between the successive needle loops 10*n* generally in the intervening courses C2**.

As those persons skilled in the art will recognize, the stitch pattern followed by the loop-forming yarns 14 causes each such yarn to be traversed during the formation of each intervening course C2 across a three-needle spacing from the needle 15A on which was formed a needle loop **14*n* in the formation of the preceding course C1 to cause the yarn 14 to extend in a non-knitting manner about the spaced needle 15B. Such needles 15B hold the loop-forming yarns 14 during the formation of the intervening courses C2 and then subsequently shed the yarns 14 without formation of needle loops thereof upon formation of the next succeeding alternate course C1 and, since such needles are not involved in the formation of needle loops of either of the ground yarns 10, 12 during the formation of the courses C2, the held extents of the loop-forming yarns 14 do not become anchored in the fabric. As a result, the underlap extents 14*u* of the loop-forming yarns 14** are substantially elongated and are free to extend outwardly from the corresponding face of the fabric, i.e. the technical back thereof.

In this fashion, the ground yarns 10, 12 form a base or ground fabric structure which provides substantial dimensional stability to the fabric, the walewise chain stitch construction of the ground yarns 12 restricting the walewise stretchability of the fabric while the construction of the ground yarns 12 with extended coursewise underlaps **12*u* similarly restricting the coursewise stretchability of the fabric. The formation of the loop-forming yarns 14 on the top guide bar of the knitting machine form such yarns predominantly at the technical back of the fabric whereat the extended underlaps 14*u* extend generally outwardly of the fabric surface in the nature of elongated terry pile loops. As a result, the underlap loops 14*u* produced by the present fabric construction make the fabric well suited for use as the loop component of a hook-and-loop fastener, the outwardly extending disposition of the underlap loops 14*u* orienting them optimally for engagement with the hook elements of a mating fastener hook component, which could be of a variety of conventional constructions. Advantageously, the elongated nature of the underlap loops 14*u* provides sufficient loop elevation from the fabric surface that napping, brushing or other mechanical raising of the loops, which is conventionally necessary in other fastener loop fabric constructions, can be avoided altogether. As aforementioned, when monofilament synthetic yarns are utilized as the loop-forming yarns 14, the relative stiffness and resiliency of such yarns further tends to cause the extended underlap loops 14***u* naturally to orient themselves in a generally upstanding disposition relative to the fabric surface which accentuates this advantage.

In use, the fabric of the present invention provides several distinct advantages over conventional fastener loop fabric construction. By selecting the ground and loop-forming yarns to be of relatively fine denier, the present fastener loop fabric construction can be made significantly lighter in weight per unit fabric dimension than corresponding conventional fastener loop fabric constructions. Further, manufacture of the present fabric construction is expedited and simplified by avoiding the necessity of brushing, napping or otherwise raising the fastener loops. As a result, the manufacturing cost of the present fabric can be relatively reduced in comparison to conventional fastener loop fabrics. While the number of available fastener loops provided by the present fabric construction may be relative reduced in comparison to conventional fastener fabric constructions when the loop-forming yarn is a monofilament yarn, the elongated upstanding nature of the loops formed by the present construction provides optimal interengagement between the loops and the hook elements of a mating hook-type fastener component so that the peel force value, i.e., the force required to peel a hook fabric component from the present loop fabric, and the shear force value, i.e., the force required to pull a hook fabric component from the present loop fabric component in a direction parallel to the loop fabric component, compare favorably with conventional fastener loop fabric constructions. Accordingly, the fastener loop fabric construction of the present invention, owing to its provision of suitable functional characteristics at relatively lower cost and lighter weight than conventional fastener loop fabric constructions, is believed to be highly suitable for various forms of one-time and disposable uses such as, for example, use as a carpet backing of the type contemplated in aforementioned U.S. Pat. No. 4,822,658.

It will be recognized by those persons skilled in the art that the particular yarns and yarn sizes (denier), as well as the particular stitch patterns followed by the constituent yarns, may be selectively varied, as desired, to modify the properties and characteristics of the resultant fabric to achieve differing embodiments of the fabric suited to differing uses, so long as the stitch construction of the several yarns in selected to achieve elongated underlaps of the loop-forming yarns which are not anchored into the fabric structure so as to permit the underlaps to extend outwardly from the resultant fabric in the nature of pile loops. Likewise, it is contemplated that the fastener loop fabric of the present invention could be of a four bar construction rather than a three bar construction, if desirable to achieve additional or different fabric properties. All such modifications and variations on the present invention are intended to be within the scope of the present invention.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiments, adaptations, variations, modifications and equivalent arrangements, the present invention being limited only by the claims appended hereto and the equivalents thereof.

I claim:

1. A warp knitted textile fabric of a three bar dimensionally stable generally non-stretchable construction having loops at one face adapted for mated engagement with hooking elements of another fabric for use in a two-component fabric fastener of the hook-and-loop type, said fabric comprising a ground layer formed of first and second sets of ground yarns interknitted together and a set of yarns warp knitted in extended underlaps at the technical back of said fabric to form a plurality of said loops extending outwardly from one face of said ground layer, said loops being formed of monofilament synthetic yarn of a relatively fine denier in the range of approximately 40 denier and smaller, wherein said first ground yarns are warp knitted in a 1-0, 4-5 stitch pattern, said second ground yarns are warp knitted in a 0-1, 1-0 chain stitch pattern, and said monofilament yarns are knitted in a 1-0, 3-4, 6-7, 3-4 stitch pattern.

2. A textile fabric according to claim 1 and characterized further in that said monofilament yarn is polyester.

3. A textile fabric according to claim 1 and characterized further in that said monofilament yarn is of approximately 30 denier.

4. A textile fabric according to claim 1 and characterized further in that said monofilament yarn is of approximately 20 denier.

5. A warp knitted textile fabric having loops at the technical back of the fabric adapted for mated engagement with hooking elements of another fabric for use in a two-component fabric fastener of the hook-and-loop type, said fabric comprising yarns formed in needle loops arranged in longitudinally extending wales and transversely extending courses including at least one set of ground yarns formed in a dimensionally stable stitch pattern of needle loops, and a set of loop-forming yarns formed in needle loops in only selected spaced courses and only selected spaced wales and in elongated underlap loops extending outwardly from the technical back of said fabric between said needle loops, each walewise adjacent pair of said needle loops of said loop-forming yarns being spaced by at least one intervening course and each coursewise adjacent pair of said needle loops of said loop-forming yarns being spaced by at least one intervening wale.

6. A warp knitted textile fabric according to claim 5 and characterized further in that each said loop-forming yarn is formed in needle loops aligned with one another in spaced courses of a common wale.

7. A warp knitted textile fabric according to claim 6 and characterized further in that each said loop-forming yarns are warp knitted in a 1-0, 3-4, 6-7, 3-4 stitch pattern.

8. A warp knitted textile fabric according to claim 5 and characterized further in that said loop-forming yarns are synthetic monofilament yarns.

9. A warp knitted textile fabric according to claim 5 and characterized further in that said ground yarns comprise a first set of ground yarns formed in needle loops in spaced wales of every course and a second set of ground yarns formed in needle loops in a chain stitch pattern in said spaced wales.

10. A warp knitted textile fabric according to claim 9 and characterized further in that said first set of ground yarns are warp knitted in a 1-0, 4-5 stitch pattern and said second set of ground yarns are warp knitted in a 0-1, 1-0 chain stitch pattern.

11. A warp knitted textile fabric according to claim 5 and characterized further in that said elongated underlap loops of said loop-forming yarns extend outwardly from the technical back of said fabric in opposite directions coursewise of said fabric.

12. A warp knitted textile fabric according to claim 11 and characterized further in that said elongated underlap loops of each said loop-forming yarn extend outwardly from the technical back of said fabric alternately in opposite directions coursewise of said fabric.

* * * * *

UNITED STATES PATENT AND TRADEMARK OFFICE

CERTIFICATE OF CORRECTION

PATENT NO. : 5,214,942

DATED : June 1, 1993

INVENTOR(S) : William L. Peake, III and Robert T. Spillane

Figure 2:
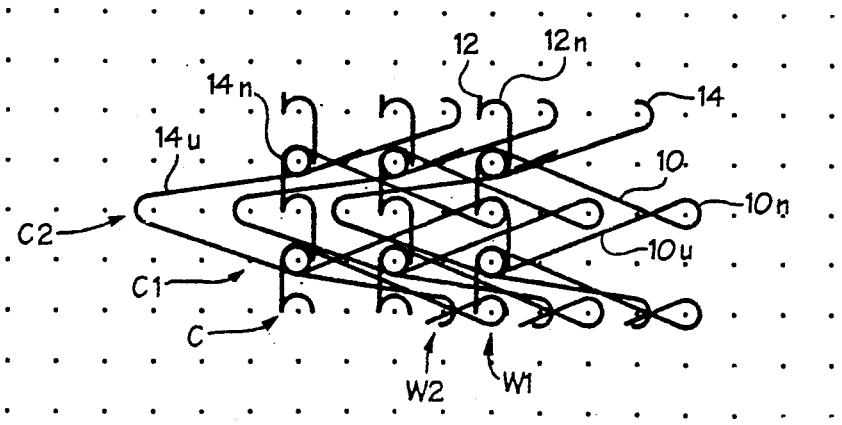
FIG. 2 composite diagram thereof.

It is certified that error appears in the above-identified patent and that said Letters Patent is hereby corrected as shown below:

Column 3, line 68, after "FIG. 2" insert -- is a --.

Column 5, line 21, after "further" insert -- , --.

Column 5, line 55, delete "1-0chain" and insert therefor -- 1-0 chain --.

Column 6, line 24, delete "10u" and insert therefor -- 14u --.

Column 6, line 25, delete "10n" and insert therefor -- 14n --.

Signed and Sealed this

First Day of March, 1994

*Attest:*

Bruce Lehman

BRUCE LEHMAN

*Attesting Officer*

*Commissioner of Patents and Trademarks*

UNITED STATES PATENT AND TRADEMARK OFFICE

CERTIFICATE OF CORRECTION

PATENT NO. : 5,214,942

DATED : June 1, 1993

INVENTOR(S) : William L. Peake, III et al

It is certified that error appears in the above-indentified patent and that said Letters Patent is hereby corrected as shown below:

The title page, showing an illustrative figure, should be deleted and substitute therefor the attached title page.

Delete Drawing Sheets 1-2 and substitute therefor the Drawing Sheets, consisting of Figs. 1-2, as shown on the attached pages.

Signed and Sealed this

Twenty-fifth Day of April, 1995

*Attest:*

*Attesting Officer*

BRUCE LEHMAN

*Commissioner of Patents and Trademarks*

United States Patent [19]

Peake, III et al.

[11] Patent Number: 5,214,942

[45] Date of Patent: Jun. 1, 1993

[54] LOOP-TYPE TEXTILE FASTENER FABRIC AND METHOD OF PRODUCING SAME

[75] Inventors: William L. Peake, III; Robert T. Spillane, both of Greensboro, N.C.

[73] Assignee: Guilford Mills, Inc., Greensboro, N.C.

[21] Appl. No.: 711,201

[22] Filed: Jun. 6, 1991

[51] Int. Cl.[5] ..... A44B 18/00

[52] U.S. Cl. ..... 66/194; 24/445

[58] Field of Search ..... 66/194, 195; 24/445

[56] References Cited

U.S. PATENT DOCUMENTS

| | | | |
|---|---|---|---|
| 3,594,873 | 7/1971 | Hockmeyer, Jr. et al. | |
| 3,597,941 | 8/1971 | Jindra et al. | 66/194 |
| 3,748,701 | 7/1973 | De Mestral . | |
| 3,943,981 | 3/1976 | De Brabander . | |
| 4,338,800 | 7/1982 | Matsuda | 66/194 |
| 4,467,625 | 8/1984 | Kurz | 66/194 X |
| 4,624,116 | 11/1986 | Rogers . | |
| 4,677,011 | 6/1987 | Matsuda | 66/194 X |
| 4,709,562 | 12/1987 | Matsuda . | |
| 4,714,096 | 12/1987 | Guay . | |
| 4,822,658 | 4/1989 | Pacione . | |
| 4,838,044 | 6/1989 | Matsuda et al. . | |
| 4,858,447 | 8/1989 | Matsuda | 66/194 X |
| 4,881,383 | 11/1989 | Spillane et al. | 66/194 |

*Primary Examiner*—James R. Brittain

*Attorney, Agent, or Firm*—Shefte, Pinckney & Sawyer

[57] ABSTRACT

A lightweight warp knitted textile fabric suitable for use as the loop component of a hook-and-loop fastener is formed of two sets of ground yarns knitted in a dimensionally stable construction with a set of loop-forming yarns formed in a stitch pattern producing elongated underlap loops extending outwardly from the technical back of the fabric which can be readily interengaged with the hook elements of a mating hook component without any necessity for brushing, napping or mechanically raising the loops. In one embodiment, the loop-forming yarns are relatively fine denier synthetic monofilament yarns whose relative stiffness and resiliency accentuates the upstanding disposition of the loops.

12 Claims, 1 Drawing Sheet

Fig. 1

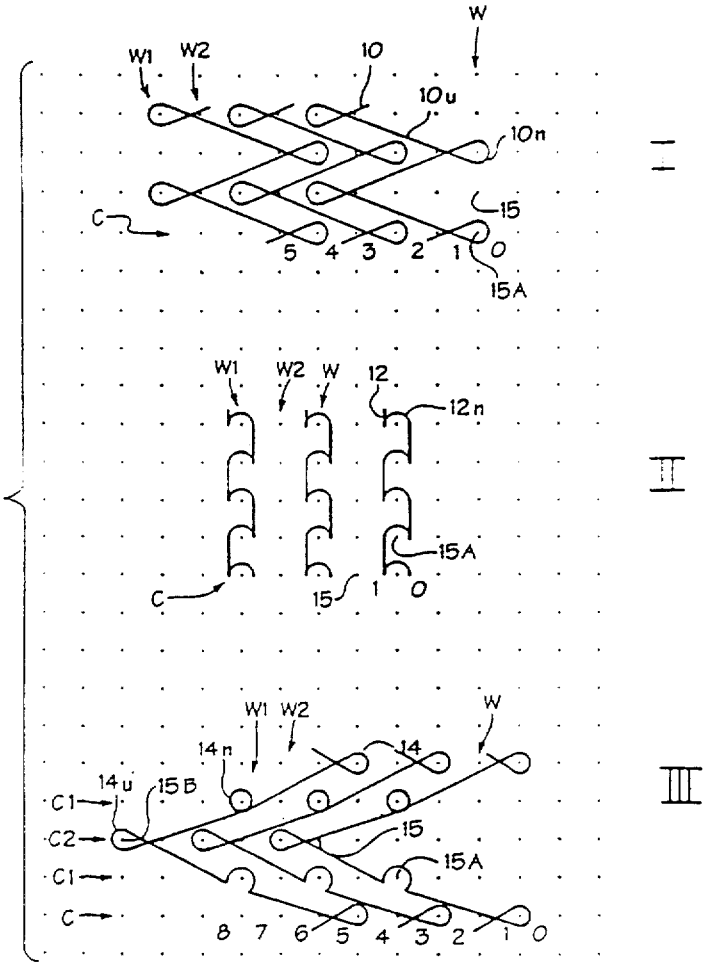

UNITED STATES PATENT AND TRADEMARK OFFICE

CERTIFICATE OF CORRECTION

PATENT NO. : 5,214,942

DATED : June 1, 1993

INVENTOR(S) : William L. Peake, III; Robert T. Spillane

It is certified that error appears in the above-identified patent and that said Letters Patent is hereby corrected as shown below:

Fig. 1

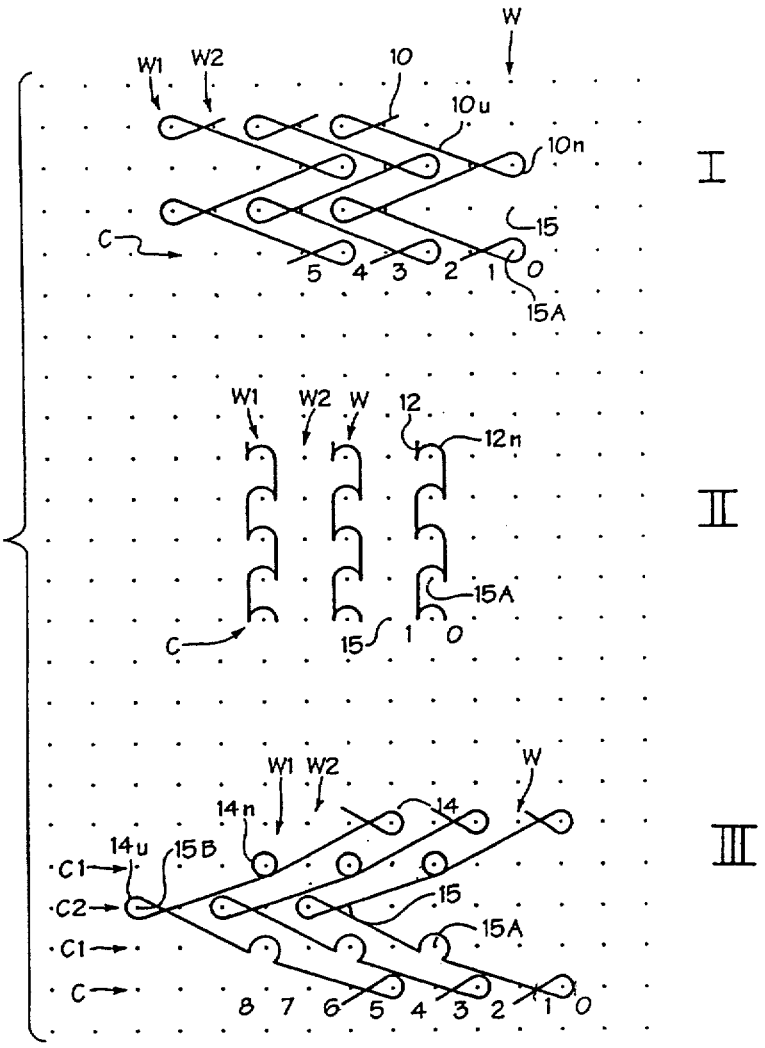

UNITED STATES PATENT AND TRADEMARK OFFICE

CERTIFICATE OF CORRECTION

PATENT NO. : 5,214,942

DATED : June 1, 1993

INVENTOR(S) : William L. Peake, III; Robert T. Spillane

It is certified that error appears in the above-identified patent and that said Letters Patent is hereby corrected as shown below:

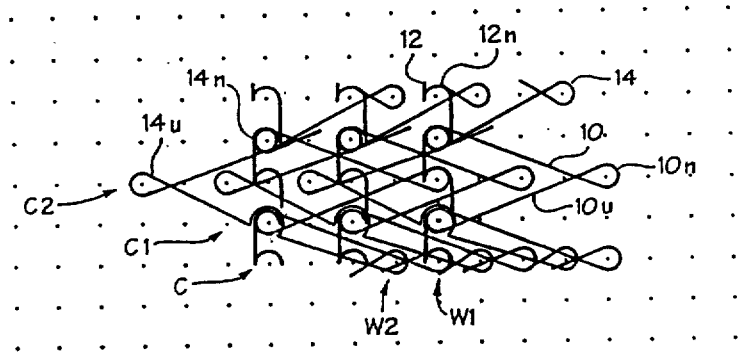

Fig. 2